US010738769B2

(12) United States Patent
Lutz et al.

(10) Patent No.: US 10,738,769 B2
(45) Date of Patent: Aug. 11, 2020

(54) DOUBLE DIAPHRAGM PUMP

(71) Applicant: J. Wagner AG, Altstatten (CH)

(72) Inventors: Gilbert Lutz, Kreissern (CH); Karsten Juterbock, Wangen (DE); Angelo Basso, Trezzo sull'Adda (IT); Thomas Kluser, Diepoldsau (CH)

(73) Assignee: Wagner International AG, Altstätten (CH)

( * ) Notice: Subject to any disclaimer, the term of this patent is extended or adjusted under 35 U.S.C. 154(b) by 254 days.

(21) Appl. No.: 15/196,159

(22) Filed: Jun. 29, 2016

(65) Prior Publication Data

US 2017/0009760 A1 Jan. 12, 2017

(30) Foreign Application Priority Data

Jul. 10, 2015 (EP) ..... 15176316

(51) Int. Cl.
*F04B 9/137* (2006.01)
*F04B 45/04* (2006.01)
(Continued)

(52) U.S. Cl.
CPC ..... *F04B 9/137* (2013.01); *F04B 43/06* (2013.01); *F04B 43/0736* (2013.01);
(Continued)

(58) Field of Classification Search
CPC ..... F04B 43/0736; F04B 49/22; F04B 9/137; F04B 45/053; F04B 45/043; F04B 43/06; F04B 45/047; F04B 2201/0201; F04B 2203/10; F04B 2205/05; F04B 43/026; F01L 21/04
See application file for complete search history.

(56) References Cited

U.S. PATENT DOCUMENTS 4,844,706 A * 7/1989 Katsuyama ..... B05B 7/24 417/339
4,854,832 A 8/1989 Gardner et al.
(Continued)

FOREIGN PATENT DOCUMENTS

DE 38 76 169 T2 3/1993
DE 103 18 004 B3 12/2004
(Continued)

OTHER PUBLICATIONS

Extended European Search Report for corresponding European Application No. 15176316.6 dated Jan. 28, 2016.

*Primary Examiner* — Patrick Hamo
*Assistant Examiner* — David N Brandt
(74) *Attorney, Agent, or Firm* — Renner, Otto, Boisselle & Sklar, LLP

(57) ABSTRACT

A first diaphragm which forms a wall of a first pump chamber is provided in the double diaphragm pump according to the invention, wherein the first diaphragm can be moved by means of a first driving means. In addition, a second diaphragm which forms a wall of a second pump chamber is provided, wherein the second diaphragm can be moved by means of a second driving means. What is more, a control for the driving means is provided, said control being designed and operable such that it controls the two driving means subject to one or a plurality of conditions.

17 Claims, 9 Drawing Sheets

(51) Int. Cl.

| | |
|---|---|
| ***F04B 45/053*** | (2006.01) |
| ***F04B 43/06*** | (2006.01) |
| ***F04B 43/073*** | (2006.01) |
| ***F04B 49/22*** | (2006.01) |
| ***F04B 53/14*** | (2006.01) |

(52) U.S. Cl.

CPC ..... *F04B 45/043* (2013.01); *F04B 45/053* (2013.01); *F04B 49/22* (2013.01); *F04B 53/14* (2013.01); *F04B 2201/0201* (2013.01); *F04B 2205/05* (2013.01)

(56) References Cited

U.S. PATENT DOCUMENTS

| | | | | |
|---|---|---|---|---|
| 5,332,372 | A * | 7/1994 | Reynolds | F04B 43/009 417/383 |
| 5,707,217 | A * | 1/1998 | Loeffler | F04B 9/115 417/339 |
| 8,313,313 | B2 | 11/2012 | Jüterbock et al. | |
| 8,360,750 | B2 * | 1/2013 | Ferk | F04B 43/025 417/389 |
| 2011/0229352 | A1 | 9/2011 | Timmer | |
| 2013/0008538 | A1 * | 1/2013 | Schutze | F01L 15/12 137/625 |
| 2013/0101445 | A1 * | 4/2013 | Schutze | F04B 43/026 417/395 |
| 2015/0375249 | A1 | 12/2015 | Schenke et al. | |

FOREIGN PATENT DOCUMENTS

| | | | |
|---|---|---|---|
| DE | 10 2007 039964 | A1 | 2/2009 |
| DE | 10 2013 003620 | A1 | 8/2014 |
| EP | 0 959 247 | A1 | 11/1999 |
| EP | 2 085 614 | A1 | 8/2009 |

* cited by examiner

DOUBLE DIAPHRAGM PUMP

CROSS-REFERENCE TO RELATED APPLICATION

The present application claims priority under 35 USC § 119 to European Patent Application No. 15176316.6, filed Jul. 10, 2015, the entire disclosure of which is incorporated herein by reference.

TECHNICAL FIELD

The invention relates to a double diaphragm pump for the supply of fluid, such as paint or varnish.

DESCRIPTION OF THE RELATED ART

The publication DE 38 76 169 T2 discloses a known double diaphragm pump. This pump comprises a first pump chamber and a second pump chamber as well as a first pressure chamber and a second pressure chamber, wherein the first pump chamber and the first pressure chamber are separated from each other by a first diaphragm and the second pump chamber and the second pressure chamber are separated from each other by a second diaphragm. The two diaphragms are mechanically connected by means of a shaft. The shaft extends axially along an axis through the center point of each of the diaphragms and is mounted to each of the diaphragms by means of two plates. As a result, the two diaphragms move in unison while the pump is operating. When pressure is applied to the first pressure chamber, the associated diaphragm is caused to compress the fluid in the allocated first pump chamber. Thus, the fluid is pressed out of the first pump chamber. At the same time, the diaphragm allocated to the second pump chamber is deflected, with the result that fluid is drawn into the second pump chamber. The diaphragms are moved to and fro in unison (synchronously with each other) in order to alternately fill and evacuate the pump chamber.

The double diaphragm pump thus designed, however, has a multitude of drawbacks which will be explained below.

At the time when the first diaphragm has reached the end of its working stroke (dead center), the supply pressure in the first pump chamber decreases considerably. Since the second diaphragm has also reached its dead center in this phase, the second pump chamber is not or not yet provided for pressing out the fluid. As a result, the supply pressure is very low or even zero until the shaft is subjected to a reversal in motion and ensures that the second diaphragm builds up supply pressure in the second pump chamber. Observed over the course of time, this behavior results in periodically recurring supply pressure drops on the outlet side of the double diaphragm pump and, therefore, in supply interruptions to a greater or lesser extent.

This double diaphragm pump has another drawback. The supply pressure depends on the material (stiffness) of the diaphragm and therefore changes during the stroke. As a result, the fluid is ejected at high pressure at the beginning of the ejection phase; among other reasons, this is due to the fact that the diaphragm is in the deflected position and is, therefore, under tension. Subsequently, the ejection pressure decreases; at the end of the stroke, it is not only the fluid that has to be pressed into the end position but the diaphragm as well. Only when the other diaphragm changes from the suction phase to the ejection phase, will the fluid again be ejected at high pressure. Observed over the course of time, the supply pressure presents an undesired serrated curve instead of a straight line.

SUMMARY OF THE INVENTION

It is an object of the invention to specify a double diaphragm pump wherein the drawbacks mentioned above are obviated or at least minimized.

The double diaphragm pump according to the invention advantageously generates a supply flow with an approximately constant supply pressure.

As a general rule, a pulsation snubber must be arranged downstream of a pump which generates a less constant supply pressure than the double diaphragm pump according to the invention. A further advantage of the double diaphragm pump according to the invention is that it does without such a pulsation snubber.

For example, the double diaphragm pump according to the invention can also be used for a two-component spraying system. The A component can be paint and the B component can be a hardener. In such a two-component spraying system, the pump which supplies the A component can be used as master while the B component is added. This can be achieved by opening the material valve for the B component at specific moments for a specific duration and adding the B component in the supply tube to the A component. This, however, requires that the B component should be supplied at a higher pressure than the A component. Otherwise, the B component will not reach the supply tube. If the pumps for the A and B components have a serrated pressure curve, the B component cannot be added as long as the pressure for the B component is higher than that for the A component. In this case, the time until the pressure for the B component is high enough must first be allowed to elapse. As a result, it is not possible to add the B component at any time. Since the double diaphragm pump according to the invention, however, has a constant pressure curve, this drawback can be obviated with that pump.

The problem is solved by a double diaphragm pump having the features as described herein.

A first diaphragm which forms a wall of a first pump chamber is provided in the double diaphragm pump according to the invention, wherein the first diaphragm can be moved by means of a first driving means. In addition, a second diaphragm which forms a wall of a second pump chamber is provided, wherein the second diaphragm can be moved by means of a second driving means. What is more, a control for the driving means is provided, said control being designed and operable such that it controls the two driving means subject to one or a plurality of conditions.

Preferably, the first and second driving means are designed such that they can be operated independently of each other. Thereby, the control for the driving means can control the first driving means independently of the second driving means. This means that, from a control point of view, the two driving means are two driving means that do not mutually influence each other.

Thus, according to an aspect, a double diaphragm pump is provided that includes: a housing containing a first diaphragm and a second diaphragm, wherein the first diaphragm forms a wall of a first pump chamber, and the second diaphragm forms a wall of a second pump chamber, a first actuator rigidly coupled to the first diaphragm via a first rod, the first actuator being configured to move the first diaphragm via the first rod, a second actuator rigidly coupled to the second diaphragm via a second rod, the second actuator being configured to move the second diaphragm via the second rod, wherein the first diaphragm is not rigidly coupled to the second diaphragm so as to allow movement of the first and second diaphragms without rigid mechanical interdependence on each other, and wherein one or more valves are provided to control movement of the first and second actuators, said one or more valves being configured such that the one or more valves controls the first and second actuators subject to one or a plurality of conditions.

Advantageous refinements of the invention result from the features presented in the dependent claims.

In one embodiment of the double diaphragm pump according to the invention, the condition relates to time, pressure, distance and/or position.

In a further embodiment of the double diaphragm pump according to the invention, the control is designed and operable such that, before the diaphragm in one pump chamber has reached its forward dead center, it already ensures that pressure is built up in the other pump chamber. Here, the forward dead center is understood to mean the dead center at which the volume in the pump chamber associated with this diaphragm is at its minimum.

In a further embodiment of the double diaphragm pump according to the invention, the control is designed and operable such that, once the low pressure in one pump chamber falls below a specific threshold value, it ensures that pressure is built up in this pump chamber.

In a further development of the double diaphragm pump according to the invention, the control is designed and operable such that it controls the two driving means at different times in relation to each other, with the result that the two diaphragms are moving offset in time in relation to each other.

In another further development of the double diaphragm pump according to the invention, the control is designed and operable such that it controls the two driving means isochronously to each other.

In the double diaphragm pump according to the invention, a first pressure chamber can be provided, said first pressure chamber being separated from the first pump chamber by the first diaphragm. What is more, a second pressure chamber can be provided, said second pressure chamber being separated from the second pump chamber by the second diaphragm.

In the double diaphragm pump according to the invention, it can, in addition, be provided that at least one of the driving means is a driving means that can be operated with compressed air.

In the double diaphragm pump according to the invention, the driving means can each, advantageously, have a piston that is movable in a cylinder or a diaphragm that is movable with compressed air.

It may also be of advantage if the driving means in the double diaphragm pump according to the invention comprise a piston that is movable in a cylinder or a diaphragm that is movable at least in one direction by means of a springy element.

In the double diaphragm pump according to the invention, the driving means can each comprise at least one sensor to register the end position.

In the double diaphragm pump according to the invention, the control can also be designed and operable such that it controls the two driving means subject to the signal coming from the sensor.

In a further development of the double diaphragm pump according to the invention, the control is designed and operable such that it initiates a reversal in direction of the driving means when the sensor at the first driving means and the sensor at the second driving means are actuated.

In another further development of the double diaphragm pump according to the invention, the first and second pump chambers each comprise a pump chamber outlet both of which end in a common pump outlet.

In an additional further development of the double diaphragm pump according to the invention, the diaphragms are mechanically prestressed at least prior to the supply phase. This allows further optimizing the pressure curve and making a fine adjustment.

In an embodiment of the double diaphragm pump according to the invention, the control comprises a differential valve which, in one position, connects a compressed air source to the first driving means such that the driving means moves the first diaphragm such that low pressure develops in the first pump chamber. In the other position, the differential valve connects the compressed air source to the second driving means such that it moves the second diaphragm such that low pressure develops in the second pump chamber.

The double diaphragm pump according to the invention is additionally to advantage in that it starts without any difficulty, in fact independently of the position the pistons and diaphragms are in at the turn-on instant. The double diaphragm pump according to the invention starts without any difficulty even if air is sucked in at the material inlet instead of material. This condition can, for example, occur on first startup while the pump is still empty or when the material storage tank is still empty.

What is more, the double diaphragm pump can be designed such that any undesired stopping of the pump is also reliably prevented. To achieve this, the double diaphragm pump can comprise the reversing valve with differential piston and a control valve, for example, a flip-flop valve.

In a further embodiment of the double diaphragm pump according to the invention, the differential valve, when being in one position, connects the compressed air source to the second driving means such that it moves the second diaphragm such that high pressure develops in the second pump chamber. In the other position, the differential valve connects the compressed air source to the first driving means such that it moves the first diaphragm such that high pressure develops in the first pump chamber.

In the double diaphragm pump according to the invention, it can finally be provided that the control comprises a flip-flop valve that can be controlled with end position switches and controls the differential valve.

The control that is supported by the end position switches is to advantage in that the end positions of the pistons or the diaphragms, respectively, can be detected in a simple and safe manner. If necessary, it can therefore be ensured that the two diaphragms complete the entire stroke.

BRIEF DESCRIPTION OF THE DRAWINGS

The invention will be illustrated in more detail below with more embodiments by means of several figures.

DETAILED DESCRIPTION OF THE INVENTION

Figure 1:
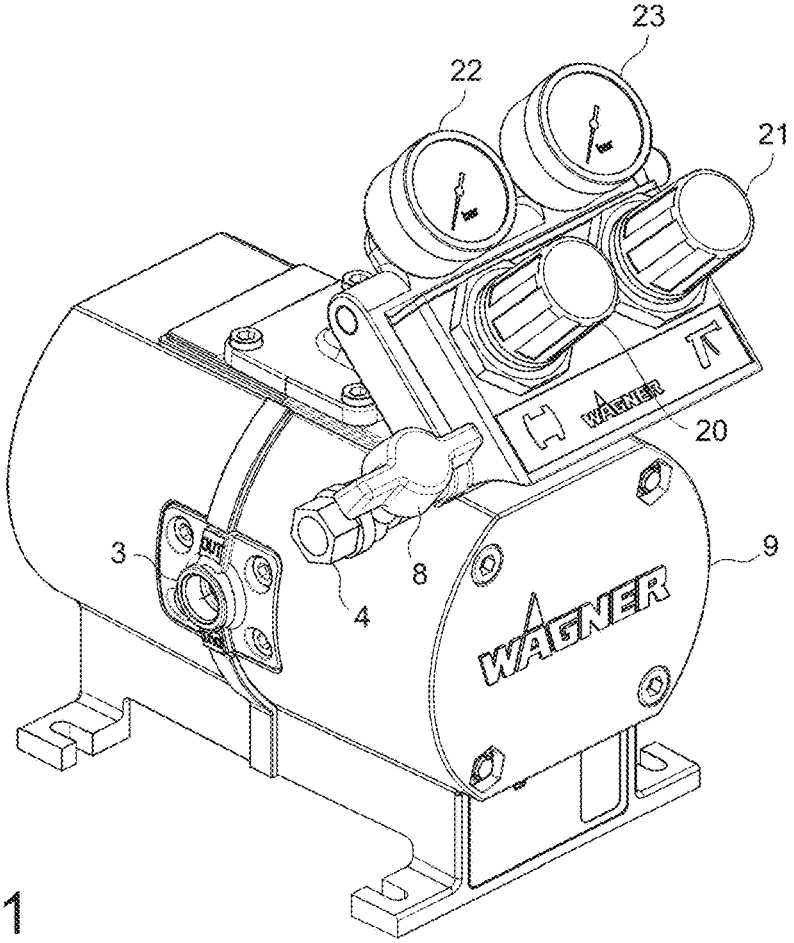
FIG. 1 is a three-dimensional view of a first potential embodiment of the double diaphragm pump according to the invention.
Figure 2:
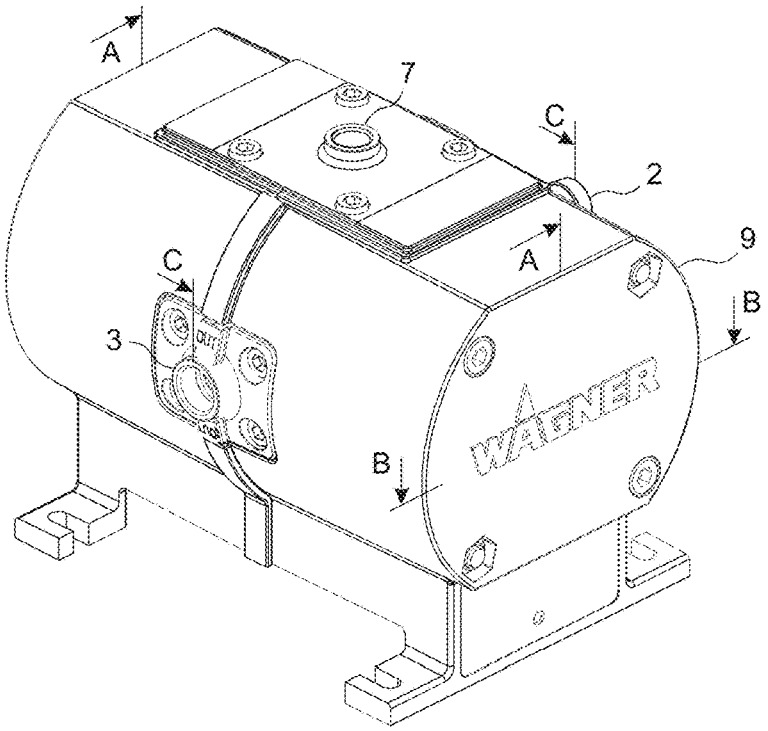
FIG. 2 is a three-dimensional view of the first embodiment of the double diaphragm pump according to the invention without fittings.

FIGS. 1 and 2 are three-dimensional views of a first potential embodiment of the double diaphragm pump 1 according to the invention. The double diaphragm pump 1 comprises a housing 9 which accommodates a first diaphragm pump and a second diaphragm pump (see FIGS. 3 and 4). An operating unit with two pressure gauges 22, 23, two pressure adjusters 20, 21, one compressed air connection 4, and one shut-off valve 8 can be arranged on the housing 9. The operating unit can be used to adjust and monitor the air pressure to supply the double diaphragm pump and the supply pressure of the double diaphragm pump. In addition, the compressed air to supply the first and second diaphragm pumps can be connected to the compressed air connection 4. FIG. 2 shows the double diaphragm pump 1 without the operating unit. A compressed air connection 7 which can be connected to the operating unit is disposed on the top of the housing 9. A pump inlet 2 for the medium to be supplied and a pump outlet 3 for the medium are disposed on the side of the housing 9. The double diaphragm pump according to the invention can be used to supply various liquid materials, such as paints, varnishes, acids, lyes, stains, solvents, water, turpentine, adhesives, glues, wastewater sludges, fuels, oils, liquid chemicals, liquid media with solid matter content, media with high viscosity, toxic media, liquid pigments, ceramic casting compound, slurries, and glazes.

Figure 3:
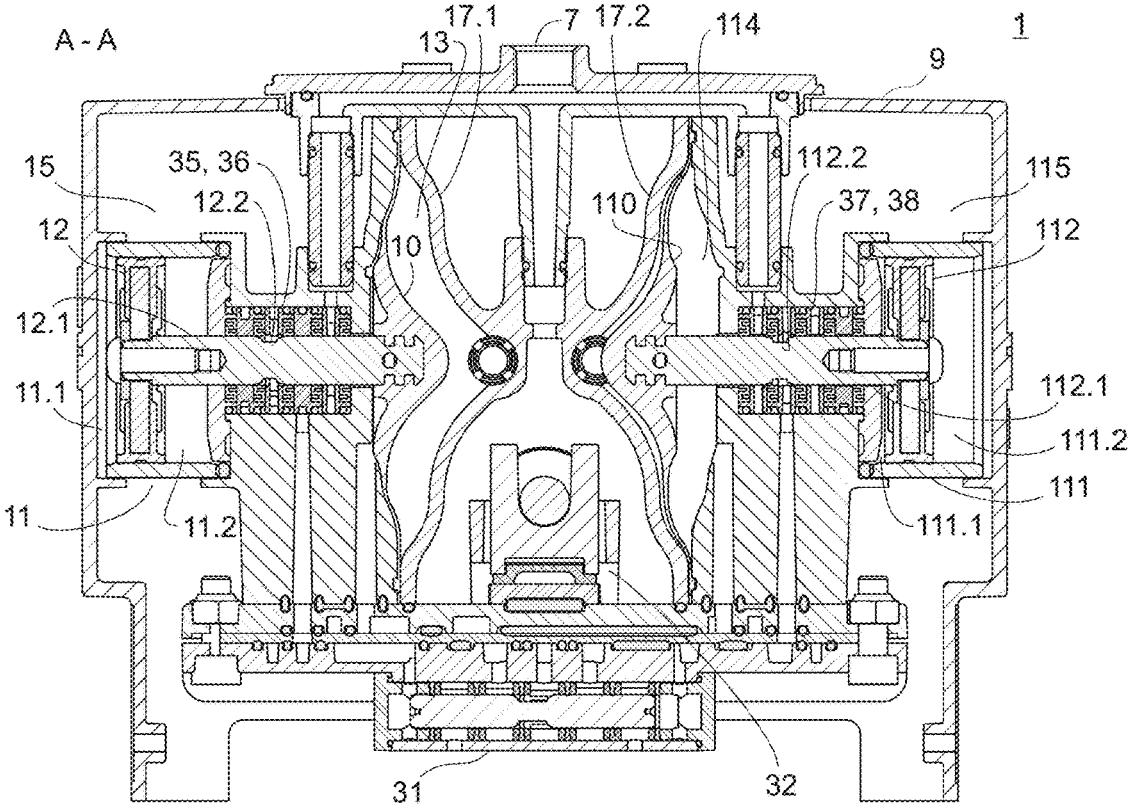
FIG. 3 is a longitudinal sectional view of the first embodiment of the double diaphragm pump according to the invention from the side.
Figure 4:
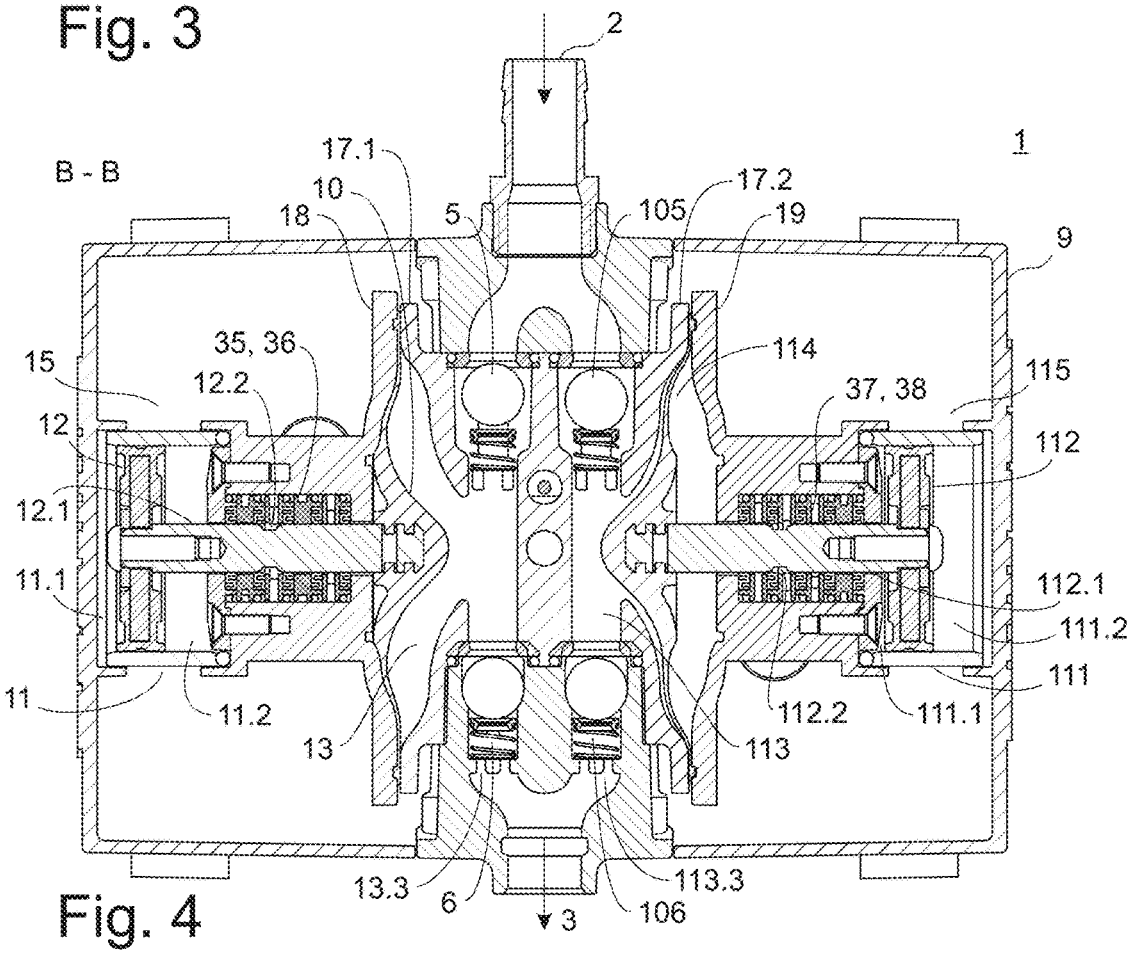
FIG. 4 is a longitudinal sectional view of the first embodiment of the double diaphragm pump according to the invention from above.
Figure 5:
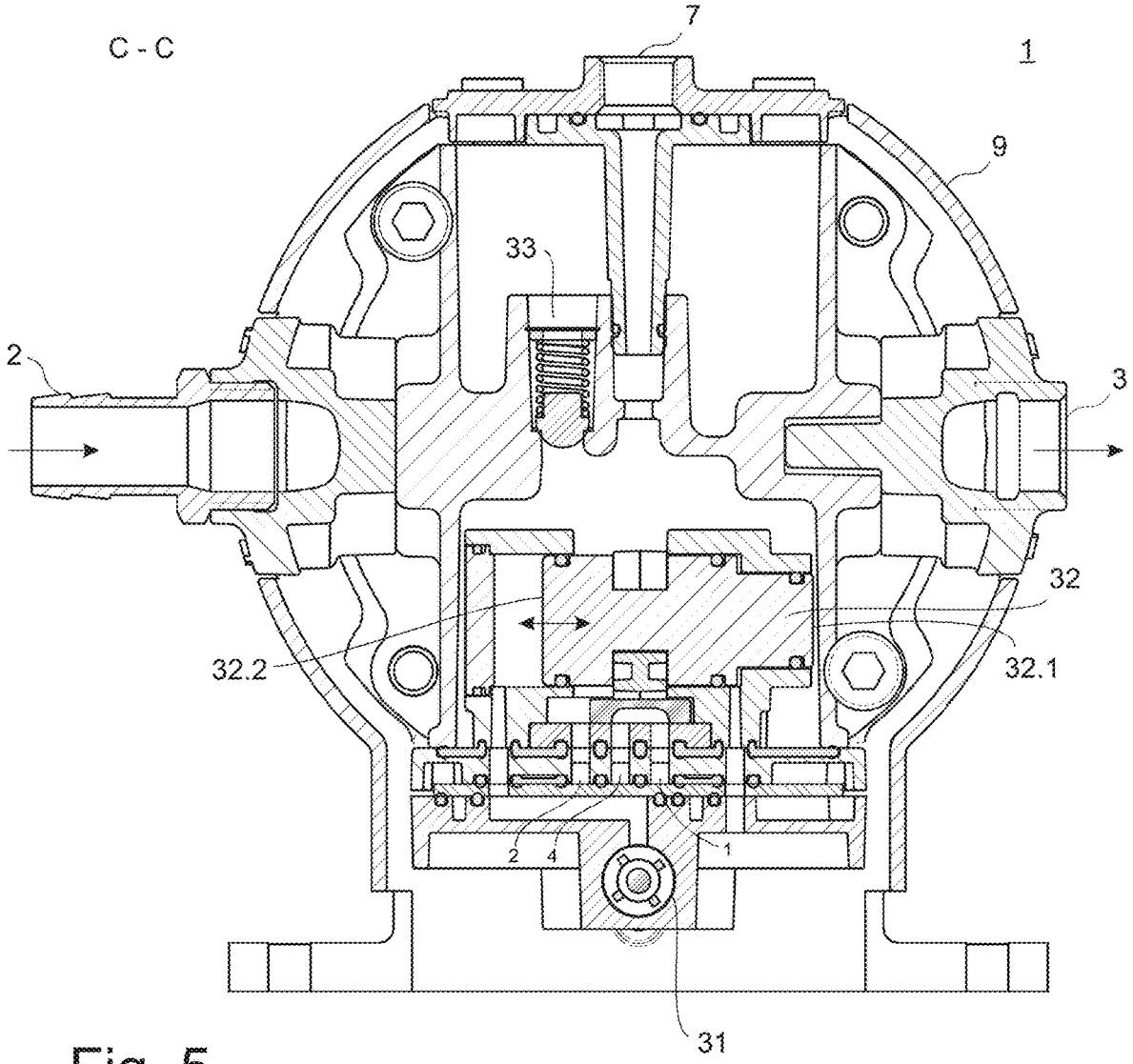
FIG. 5 is a cross-sectional view of the first embodiment of the double diaphragm pump according to the invention.

FIG. 3 is a longitudinal sectional view of the first embodiment of the double diaphragm pump according to the invention from the side along section A-A. FIG. 4 is a longitudinal sectional view of the first embodiment of the double diaphragm pump according to the invention from above along section B-B. FIG. 5 is a cross-sectional view of the double diaphragm pump according to the invention along section C-C. As has already been mentioned, the double diaphragm pump according to the invention comprises two individual diaphragm pumps which can be controlled by means of an appropriately designed control 30 (see FIGS. 6, 7 and 8).

First Diaphragm Pump

The first diaphragm pump is shown to the left in FIGS. 3 and 4. It comprises a diaphragm 10 which, preferably, is designed circular and which, at its outer end, is mounted between the walls 18 and 17.1. The diaphragm 10 forms a flexible partition wall between the walls 18 and 17.1. In this manner, the diaphragm 10 along with the wall 18 forms a first chamber which will be referred to as compressed air chamber or, in short, as pressure chamber 14 below. In addition, the diaphragm 10 along with the wall 17.1 forms a second chamber which will be referred to as supply chamber or pump chamber 13 below. The diaphragm 10 is moved to and fro by means of a driving means 15. The driving means 15 comprises a cylinder 11 with two cylinder chambers 11.1 and 11.2. The driving means 15 can also comprise the compressed air chamber 14. A movably supported piston 12 which is connected to the diaphragm 10 via a piston rod 12.1 is disposed therebetween. At one of its ends, the piston rod 12.1 can be connected to the piston 12 by means of a screw. In the stead thereof, the end of the piston rod 12.1 can also be provided with an external thread and mounted to the piston 12 by means of a nut. At its other end, the piston rod 12.1 projects through the wall 18 and is connected to the diaphragm 10, for example, by means of form closure. To achieve this, the diaphragm 10 can be injection-molded around the piston rod 12.1. The piston rod 12.1 comprises a groove 12.2. Together with valve bodies, they form two valves 35 and 36. These valves, preferably, serve as end position switches. The piston rod 12.1, however, can also be designed such that it serves to actuate two valves 35, 36.

The two valves 35 and 36 each have a control input and can each enter two switching statuses A or B. In the resting state, i.e., when there is no signal applied to the control inputs of the valves 35 and 36, the valves 35 and 36 are in switching status B (see also FIG. 6). When the piston 12 and, therefore, the piston rod 12.1 as well are disposed at the outermost left, the valve 35 is in switching status A and the valve 36 is in switching status B. When the piston 12 and the piston rod 12.1 are disposed far enough to the right, the valve 35 is in switching status B and the valve 36 is in switching status A.

Second Diaphragm Pump

In the first embodiment of the double diaphragm pump according to the invention, the second diaphragm pump is designed mirror-inverted in relation to the first diaphragm pump. This is advantageous, but not necessarily required.

The second diaphragm pump is shown to the right in FIGS. 3 and 4. It comprises a diaphragm 110 which, preferably, is designed circular and which, at its outer end, is mounted between the walls 17.2 and 19. The diaphragm 110 forms a flexible partition wall between the walls 17.2 and 19. In this manner, the diaphragm 110 along with the wall 19 forms a first chamber which will be referred to as compressed air chamber or, in short, as pressure chamber 114 below. In addition, the diaphragm 110 along with the wall 17.2 forms a second chamber which will be referred to as pump chamber or supply chamber 113 below. The diaphragm 110 is moved to and fro by means of a driving means 115. The driving means 115 comprises a cylinder 111 with two cylinder chambers 111.1 and 111.2. The driving means 115 can also comprise the compressed air chamber 114. A movably supported piston 112 which is connected to the diaphragm 110 via a piston rod 112.1 is disposed therebetween. At one of its ends, the piston rod 112.1 can be connected to the piston 112 by means of a screw. In the stead thereof, the end of the piston rod 112.1 can also be provided with an external thread and mounted to the piston 12 by means of a nut. At its other end, the piston rod 112.1 projects through the wall 18 and is connected to the diaphragm 110. The piston rod 112.1 comprises a groove 112.2 which can be designed as an annular groove. Together with the associated valve bodies, they form two valves 37 and 38. The valves 37 and 38 serve as end position switches.

The two valves 37 and 38 can each be in two switching statuses A or B. When the piston 112 and, therefore, the piston rod 112.1 as well are disposed at the outermost right, the valve 37 is in switching status A and the valve 38 is in switching status B. When the piston 112 and the piston rod 112.1 are disposed far enough to the right, the valve 37 is in switching status B and the valve 38 is in switching status A (see also FIGS. 6, 7 and 8).

As a matter of principle, there is no mechanical coupling between the first and second diaphragm pumps. In order that the double diaphragm pump 1 according to the invention supplies the desired amount of material at the desired pressure and the desired pressure curve, the first and second diaphragm pumps are driven by means of compressed air and controlled accordingly.

The double diaphragm pump according to the invention is to advantage in that the two diaphragms 10 and 110 of the double diaphragm pump 1 can be arranged independently of each other. The diaphragms 10 and 110 can, for example, be disposed opposite to each other (left, right) as shown in the figures. However, the two diaphragms 10, 110 can also be disposed one on top of the other (at the top and at the bottom), side by side or staggered in relation to each other.

The pump inlet 2 is connected both to the inlet of the supply chamber 13 and the inlet of the supply chamber 113. In order to ensure that the material to be supplied does not flow from the supply chamber back to the inlet 2 during the supply phase, the check valves 5 and 105 are provided.

The outlets 13.3 and 113.3 of the supply chambers 13 and 113 are connected to each other and end in the pump outlet 3 on the housing 9. In order to prevent the material to be supplied from flowing from one supply chamber to the other supply chamber, the check valves 6 and 106 are provided.

In the first embodiment, a main valve 32 is disposed between the two diaphragm pumps, as seen from a spatial view. As a matter of course, the main valve 32 can, however, also be disposed at a different place. The main valve 32 has two control inputs 32.1 and 32.2 and two switching statuses or positions A and B (for the mechanical structure, see FIGS. 3 and 5, and for the functional principle, see FIGS. 6, 7 and 8). In the present embodiment, it is designed as a differential valve. However, this is not necessarily required.

A flip-flop valve 31 with four switching statuses or positions A, B, C and D is disposed below the main valve (see also FIGS. 3 and 6). The flip-flop valve 31 can, however, also be disposed at a different place. The functional principle of the flip-flop valve 31 will be illustrated in more detail at a later point.

Figure 6:
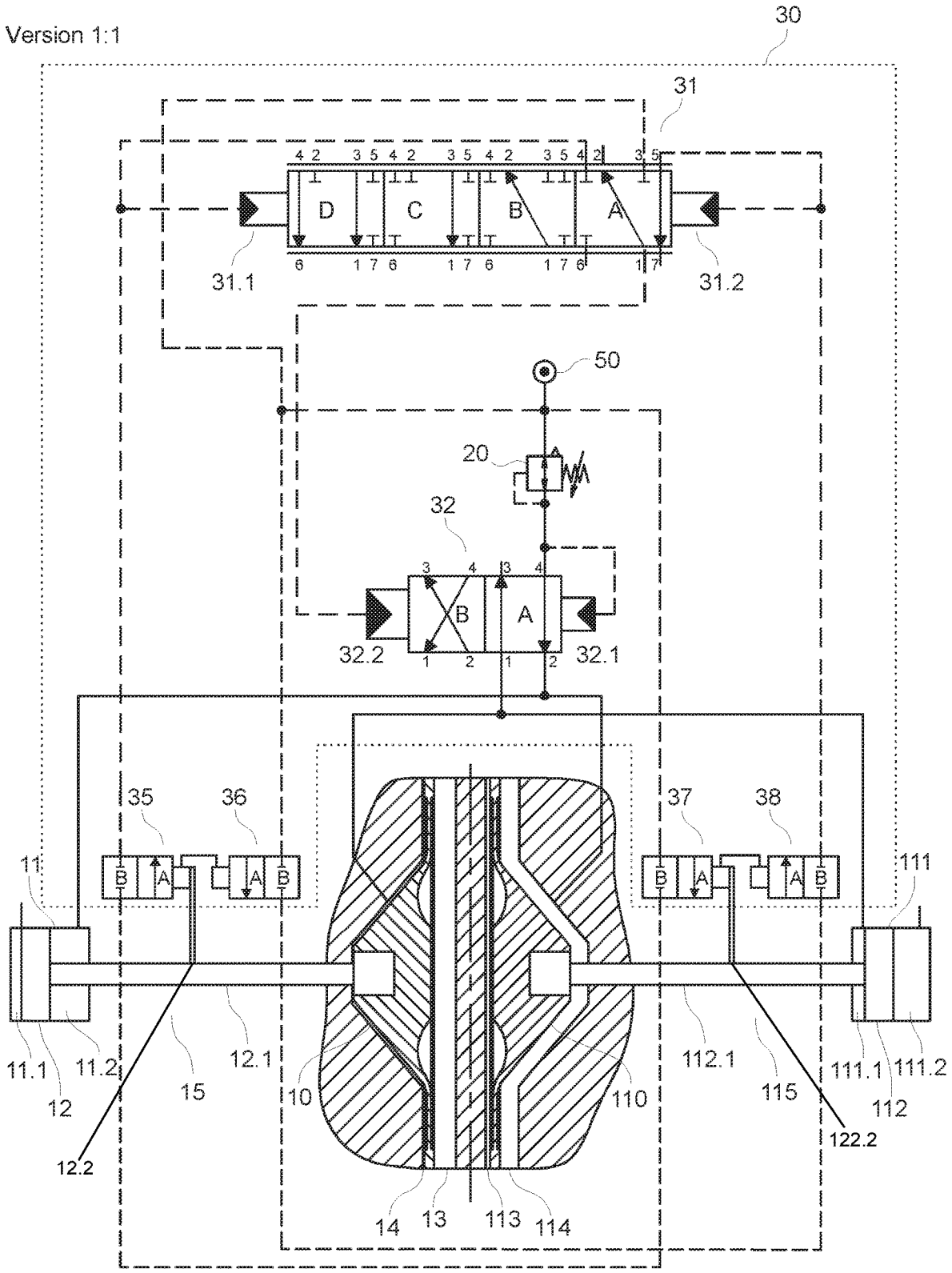
FIG. 6 is a block diagram of the structure of the first embodiment of the double diaphragm pump according to the invention.
Figure 7:
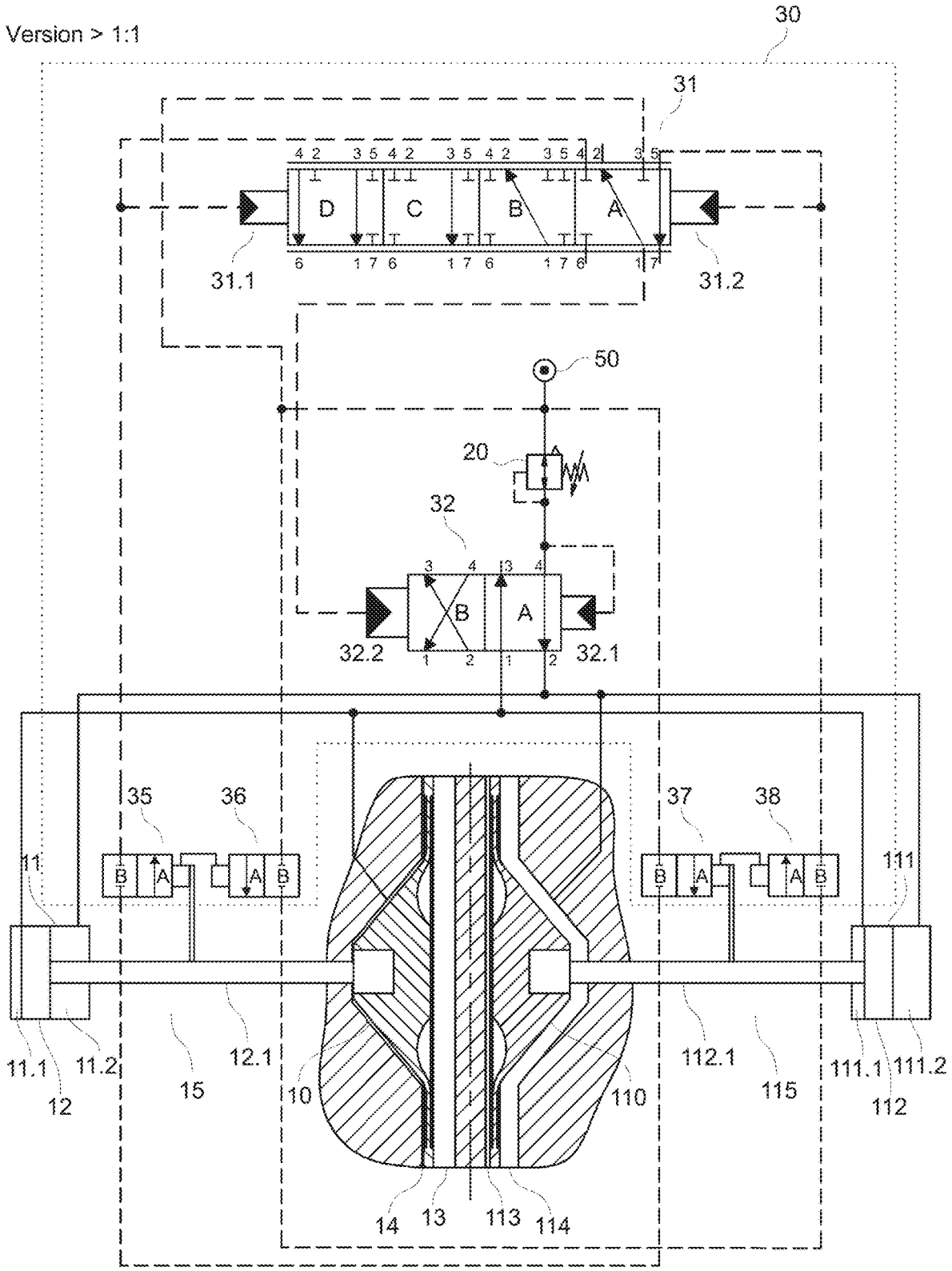
FIG. 7 is a block diagram of the structure of a second embodiment of the double diaphragm pump according to the invention.
Figure 8:
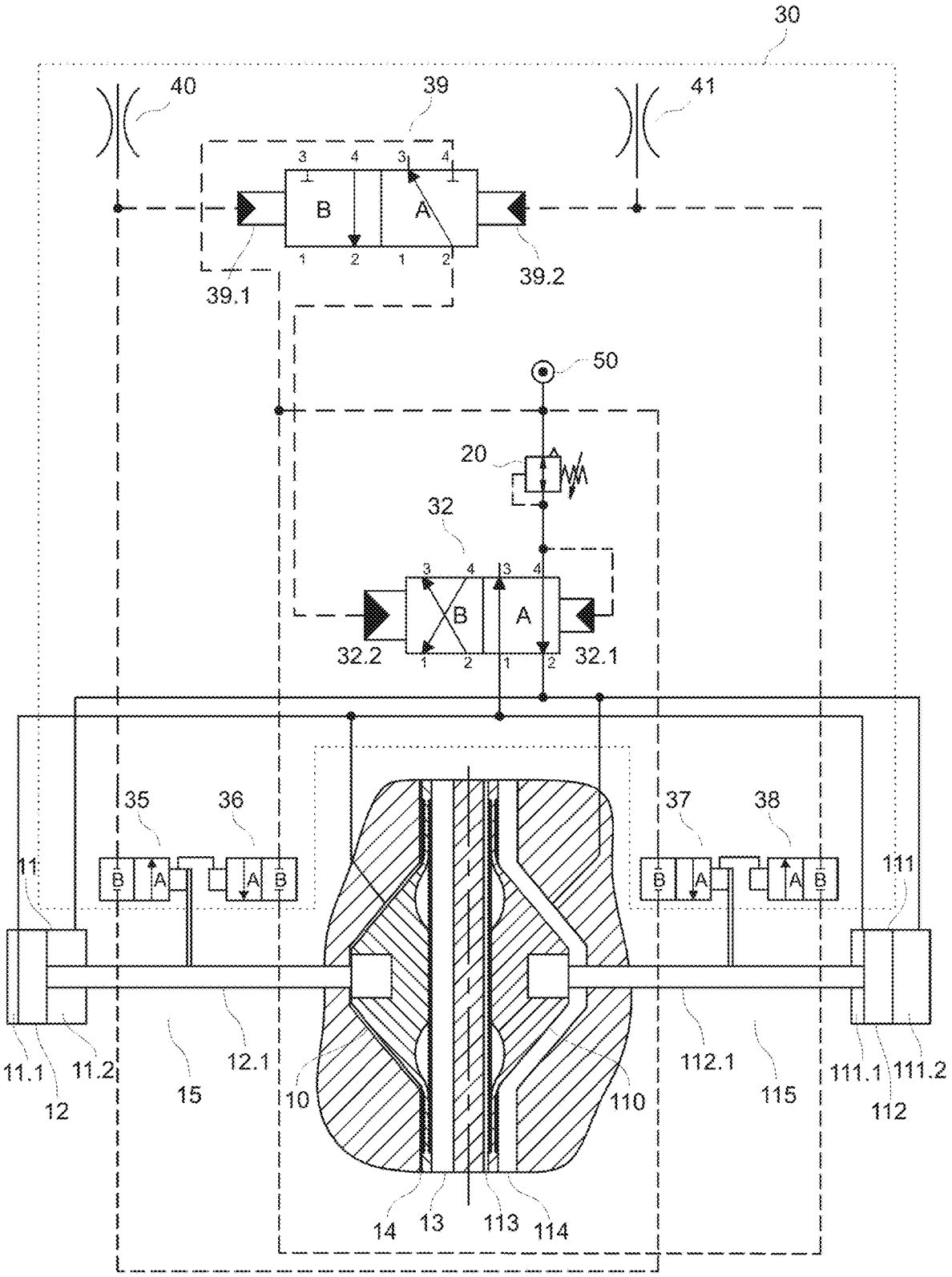
FIG. 8 is a block diagram of the structure of a third embodiment of the double diaphragm pump according to the invention.

FIGS. 6 to 8 show how the first diaphragm pump, the second diaphragm pump and the valves 31 to 37 can be connected to each other.

The control 30 controls the two driving means 15 and 115. As a matter of principle, it is designed and operable such that it controls the two driving means 15 and 115 subject to one or a plurality of conditions. For example, one condition can be a specific time period, the achieving of a specific position or the achieving of a specific pressure.

A plurality of embodiments of the control 30 will be described below.

Time-Dependent Control

Figure 9:
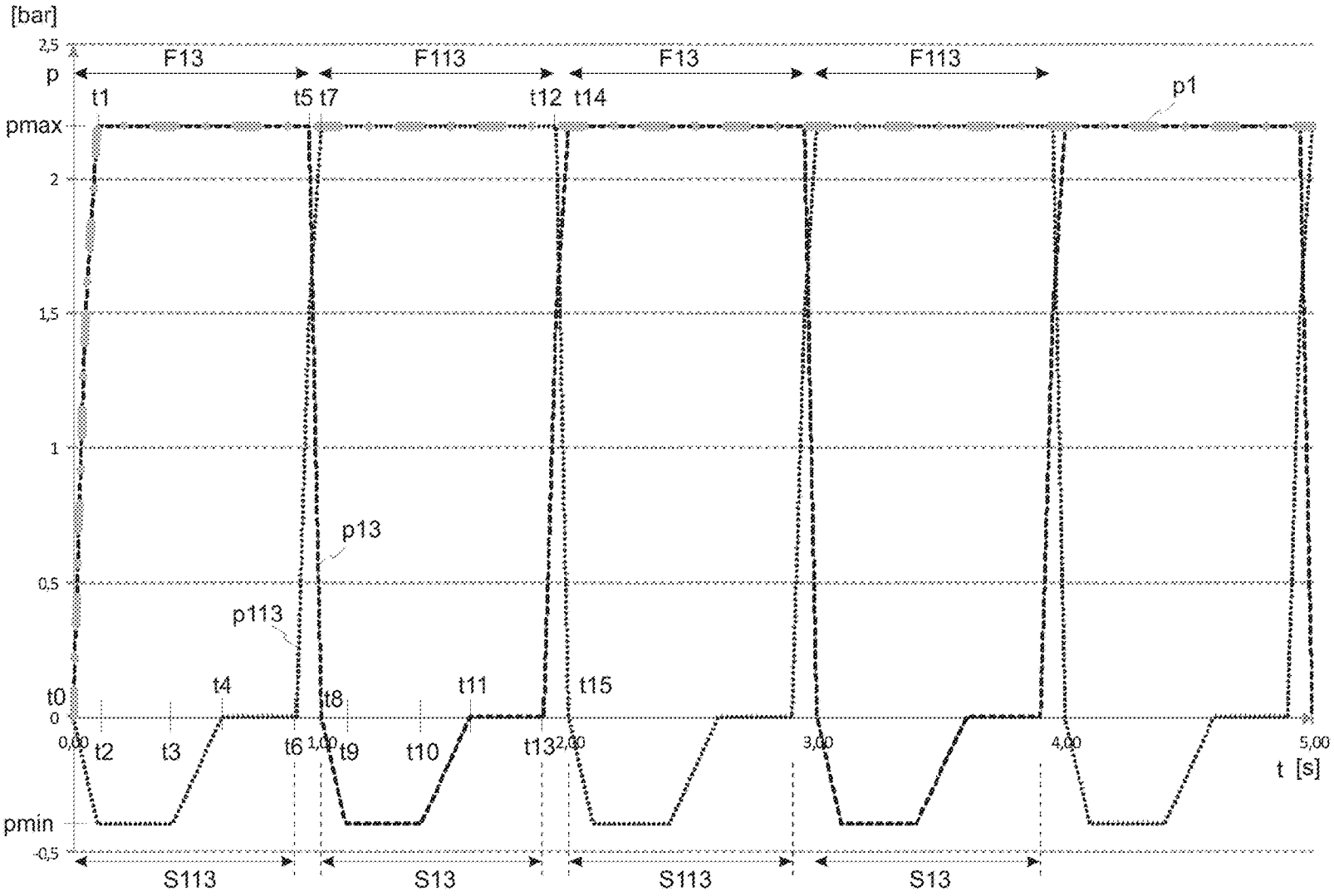
FIG. 9 is a diagram of the curves of the individual pressures and the total pressure over time.

The position the diaphragm 10 is in when the double diaphragm pump 1 is switched off will be referred to as the resting state of the diaphragm 10 below. The same applies analogously to the diaphragm 110. As a matter of principle, the positions the diaphragms 10 and 110 are in when the double diaphragm pump 1 is being switched off is of no relevance. In order to better illustrate the functional principle of the double diaphragm pump 1, however, it is assumed below that, in the resting state, the diaphragm 10 is at its left-hand dead center and the diaphragm 110 is at its left-hand dead center. The diaphragm 10 is at its left-hand dead center when it is deflected to its outermost left, which will be referred to as the rear end position of the diaphragm 10. In FIG. 9, the diaphragm 10 is at its left-hand dead center at the time t0. The diaphragm 10 is at its right-hand dead center when it is deflected to its outermost right, which will be referred to as the front end position of the diaphragm 10. The same applies analogously to the diaphragm 110. Thus, the diaphragm 110 is at its left-hand dead center when it is deflected to its outermost left, which will be referred to as the front end position of the diaphragm 110. The diaphragm 110 is at its right-hand dead center when it is deflected to its outermost right, which will be referred to as the rear end position of the diaphragm 110. In FIG. 9, the diaphragm 110 is at its left-hand dead center at the time t0.

Below, the functional principle of the double diaphragm pump 1 with the structure shown in FIGS. 1 to 5 and the pneumatic diagram shown in FIG. 6 will be illustrated in more detail by means of the diagram shown in FIG. 9. The double diaphragm pump 1 starts operating when the pistons 12 and 112 start to move the two diaphragms 10 and 110. In the present example, the control 30 ensures that the diaphragm 10 is pressed into the pump chamber 13 via the piston 12 at the time t0=0 sec and pressure p13 is built up in the pump chamber 13. The pressure p13 rises in the form of a ramp in the pump chamber 13 until it has reached the maximum pressure pmax (approx. 2.2 bar in the present example) at the time t1 and then remains constant until the time t5 (i.e., for a time period of approx. 0.8 sec). During this time period, the piston 12 presses the diaphragm 10 to the right until it has reached its right-hand dead center. Thereafter, the pressure p13 in the pump chamber 13 drops rapidly until it has dropped to zero at the time t8. The process taking place between the two times t0 and t8 is referred to as the pump or supply phase F13 of the left-hand part of the double diaphragm pump 1. During this phase, the fluid present in the pump chamber 13 is pressed out of the pump chamber. This means that the left-hand part of the double diaphragm pump 1 (left-hand diaphragm pump) supplies fluid during this time period.

Subsequently, the control 30 ensures that the diaphragm 10 is pulled out of the pump chamber 13 via the piston 12 at the time t8=1.0 sec and low pressure p13 is built up in the pump chamber 13. The pressure p13 in the pump chamber 13 drops in the form of a ramp until it has reached the maximum low pressure pmin (in the present example approx. −0.5 bar in relation to the normal pressure of 1 bar which is shown as zero line in the diagram) and then remains constant until the time t10 (i.e., for a time period of approx. 0.3 sec). During this time period, the piston 12 pulls the diaphragm 10 to the left until it has reached its left-hand dead center at the time t10. From that time on, no more fluid is sucked into the pump chamber 13. The check valve 5 in the suction line closes. From that time on, the low pressure in the pump chamber 13 again decreases, again reaches a value of zero at the time t11 and then remains zero until the time t13. The process taking place between the two times t8 and t13 is referred to as suction phase S13. This means that the left-hand part of the double diaphragm pump 1 sucks in fluid during this time period. The suction phase S13 is followed by another supply phase F13 and another suction phase S13. The supply phase F13 and the suction phase S13 take turns and, together, form a cycle.

In addition, the control 30 ensures that the diaphragm 110 is pulled out of the pump chamber 113 via the piston 112 at the time t0=0 sec and low pressure p113 is built up in the pump chamber 113 (see FIG. 9). The pressure p113 drops in the form of a ramp in the pump chamber 113 until it has reached the maximum low pressure pmin (approx. −0.5 bar in the present example) at the time t2 and then remains constant until the time t3 (i.e., for a time period of approx. 0.3 sec). During this time period, the piston 112 pulls the diaphragm 110 to the right until it has reached its right-hand dead center at the time t3. From that time on, no more fluid is sucked into the pump chamber 113. The check valve 105 in the suction line closes. From that time on, the low pressure in the pump chamber 113 again decreases, again reaches a value of zero at the time t4 and then remains zero until the time t6. The process taking place between the two times t0 and t6 is referred to as suction phase S113. This means that the right-hand part of the double diaphragm pump 1 (right-hand diaphragm pump) sucks in fluid during this time period.

Subsequently, the control 30 ensures that the diaphragm 110 is pressed back into the pump chamber 113 via the piston 112 at the time t6=0.9 sec and high pressure p113 is built up in the pump chamber 113. The pressure p113 rises in the form of a ramp in the pump chamber 113 until it has reached the maximum pressure pmax (approx. 2.2 bar in the present example) at the time t7 and then remains constant until the time t12 (i.e., for a time period of approx. 0.8 sec). During this time period, the piston 112 presses the diaphragm 110 to the left until it has reached its left-hand dead center. From then on, the pressure p113 drops rapidly in the pump chamber 113. The process taking place between the two times t6 and t15 is referred to as the pump or supply phase F113 of the right-hand part of the double diaphragm pump 1. During this phase, the fluid present in the pump chamber 113 is pressed out of the pump chamber 113. This means that the right-hand part of the double diaphragm pump 1 supplies fluid during this time period. The supply phase F113 is followed by another suction phase S113 and another ejection phase F113. The ejection phase F113 and the suction phase S113 take turns, together form a cycle and are recurring periodically.

The control 30 is used to ensure that the supply phase F13 of the left-hand part of the double diaphragm pump is followed by the supply phase F113 of the right-hand part of the double diaphragm pump and that this is again followed by a supply phase F13 of the left-hand part of the double diaphragm pump, etc. In this manner, the supply phases F13 and F113 of the left-hand and right-hand parts of the double diaphragm pump take turns, thus generating a continuous uninterrupted fluid flow at a constant supply pressure p1 after a short start-up phase.

In the present exemplary embodiment, the control 30 is designed such that it sends compressed air signals at specific points in time. As a matter of principle, however, these do not have to be compressed air signals; they can also be hydraulic or electric signals, i.e., any appropriate form of commands. For that reason, they are referred to as commands below. The condition of when a specific command is issued, therefore, relates to the time and, preferably, to a specific time period. For example, it can be provided that the command "Starting supply phase F113" is issued 0.9 sec after the suction phase S113 has been started (see FIG. 9). In the stead thereof, the command "Starting supply phase F113" can also be issued t6=0.8 sec after the suction phase S113 has been started (see FIG. 11). However, the command may also be "Building up primary pressure pv in supply chamber 13" and may be issued 0.35 sec after the suction phase S113 has been started (see FIG. 10).

In injection molding, the nozzle used in the spray gun usually specifies the speed or the frequency, respectively, at which the pump operates. If the pump is operated with a single spray gun, it operates at a different frequency than when it supplies two spray guns. The cycle times may, therefore, vary depending on the operating conditions. The working frequency of the double diaphragm pump remains constant as long as the external operating conditions remain unchanged.

Position or Distance-Dependent Control

Figure 10:
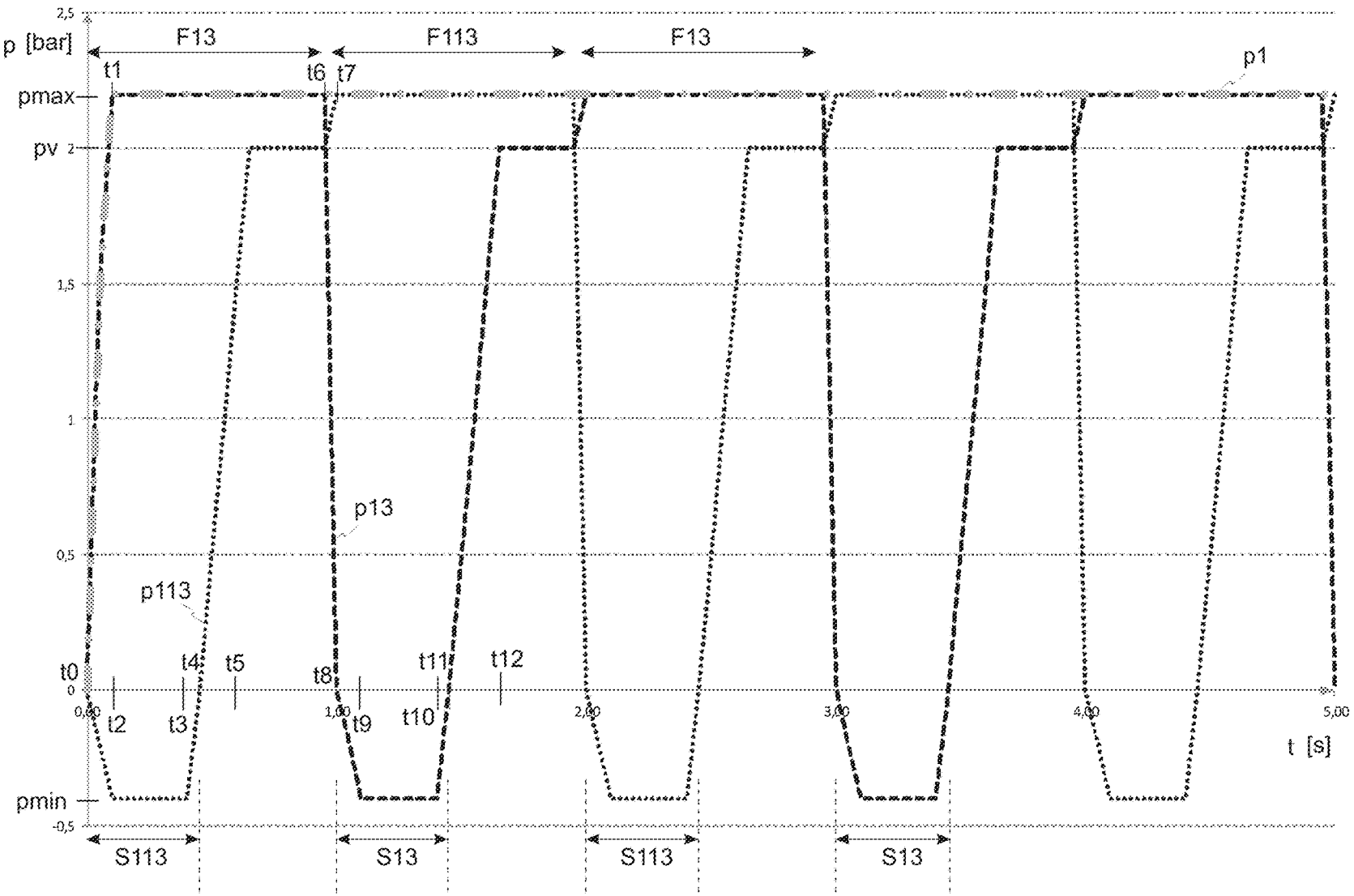
FIG. 10 is a diagram of the curves of the individual pressures and the total pressure over time.
Figure 11:
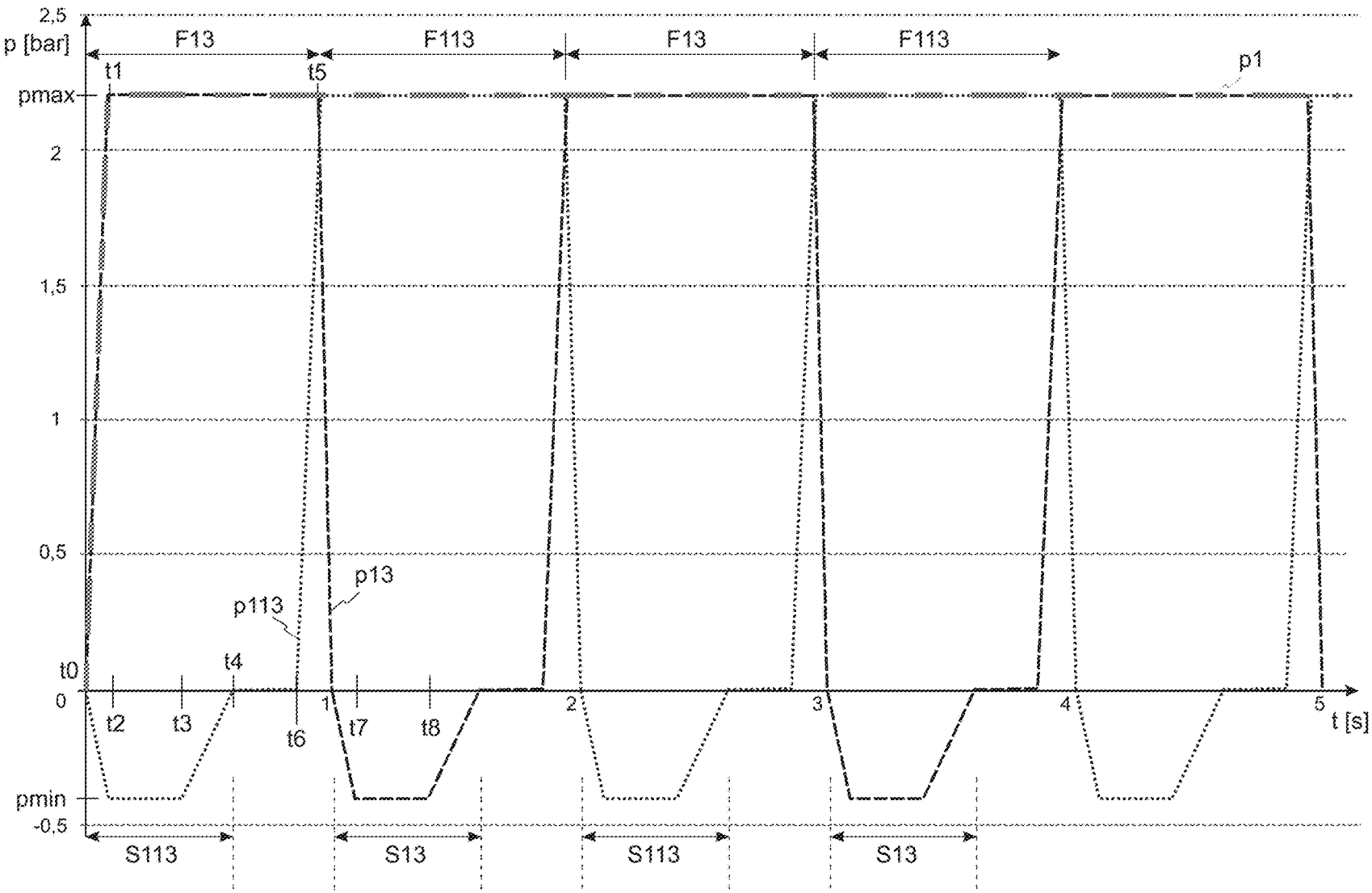
FIG. 11 is a diagram of the curves of the individual pressures and the total pressure over time.

The control 30 can also be designed such that it issues a command or commands when the piston 12 or 112, respectively, or the diaphragm 10 or 110, respectively, or any other movable component reaches a specific position or has covered a specific distance. The condition of when a specific command is issued therefore relates to the position of a specific component or to the distance that has been covered by a specific component. For example, it can be provided that the command "Starting supply phase F113" is issued when the piston 12 has reached position x. The diagram shown in FIG. 9 would correspond to the time t6. In the stead thereof, the command "Starting supply phase F113" may also be issued when the piston 12 has reached position x-1 (see t6, FIG. 11). However, the command may also be "Building up a primary pressure in supply chamber 13" and may be issued when the piston 112 has reached position z. In the diagram of FIG. 10, position z corresponds to the time t3.

Pressure-Dependent Control

The control can also be designed such that it issues a command or commands when the pressure p13 in the pump chamber 13 or the pressure p113 in the pump chamber 113 or the air pressure in one of the cylinders 11 or 111 has reached a specific threshold value. The condition of when a specific command is issued, therefore, relates to the pressure at a specific place. For example, it can be provided that the command "Building up preliminary pressure pv in supply chamber 13" is issued when the low pressure p113 in the pump chamber 113 has decreased by or to a specific value. In the diagram of FIG. 10, this would correspond to the point in time between the times t3 and t4.

Embodiment with a Pressure Transmission Ratio of 1:1

The exemplary embodiment of the double diaphragm pump according to the invention shown in FIG. 6 has a pressure transmission ratio of 1:1. This means that the pressure acting on the pump chamber is, in essence, as high as the pressure acting on the pressure chamber.

The control 30 comprises the flip-flop valve 31 with the four switching statuses or positions A, B, C and D. The switching statuses A and D are the switching statuses which are preserved even after the control signal has been removed. This means that the switching status that was the last to be taken, i.e., either A or D, is stored. The switching statuses B and C of the flip-flop valve 31 are transitional positions. This means that, if compressed air is applied to the control input 31.1 of the flip-flop valve 31, the flip-flop valve 31 initially moves to the transitional position C for a specific time period, then it moves to the transitional position B for a specific time period, and then, finally it remains in position A. The same applies analogously to the opposite direction. This means that, if compressed air is applied to the control input 31.2 of the flip-flop valve 31, the flip-flop valve 31 initially moves to the transitional position B for a specific time period, then it moves to the transitional position C for a specific time period, and then, finally it remains in position D.

If the flip-flop valve 31 is in position A, as shown in FIG. 6, the connections 1 and 2 are connected to each other, with the result that air can flow from connection 1 to connection 2. In addition, the connections 5 and 7 are connected to each other in position A. If the flip-flop valve 31 is in position B (not shown in the figures), the connections 1 and 2 are connected to each other. In position B, however, the connections 5 and 7 are not connected to each other. If the flip-flop valve 31 is in position C (not shown in the figures), only the connections 1 and 3 are connected to each other. If the flip-flop valve 31 is in position D (not shown in the figures), the connections 1 and 3 are connected to each other. In addition, the connections 4 and 6 are also connected to each other in position D. The position the flip-flop valve 31 is in (A to D) depends on whether compressed air is applied to the control connection 31.1 or to the control connection 31.2. There may indeed be cases where the flip-flop valve 31 is in position A, B, C or D for a short time only.

The control 30 additionally comprises a main valve 32 with two control inputs 32.1 and 32.2 and two switching statuses or positions A and B. If compressed air is applied to the control input 32.1, the valve 32 moves to switching status A. In switching status A, the connections 1 and 3 are connected to each other. In addition, the connections 2 and 4 are connected to each other in switching status A. If compressed air is applied to the control input 32.2, the valve 32 moves to switching status B. In switching status B, the connections 1 and 4 are connected to each other (see also FIG. 5). In addition, the connections 2 and 3 are connected to each other in switching status B.

Moreover, a pressure relief valve 33 is provided which, on the one hand, is connected to a compressed air source 50 and, on the other hand, to the main valve 32. The pressure relief valve 33 can also be designed as an adjustable pressure relief valve.

What is more, the control 30 comprises four valves 35, 36, 37, and 38. The valve 35 is coupled to the drive 15 and can move to two switching statuses A or B. When the diaphragm 10 or the drive piston 12, respectively, is in the rear end position, the valve 35 is in switching status A. In this status, the valve connections are connected to each other. If the diaphragm 10 or the drive piston 12, respectively, is in the front end position or, as shown in FIG. 6, between the front and the rear end positions, the valve 35 is in switching status B. In this status, the valve connections are not connected to each other. The valve 36 is in position A when the piston 12 is at the outermost right; otherwise, it is in switching status B.

The valve 37 can be identical in construction with the valve 35 and is coupled to the drive 115. When the diaphragm 110 or the drive piston 112, respectively, is in the front end position, the valve 37 is in switching status A. In this status, the valve connections are connected to each other. If the diaphragm 110 or the drive piston 112, respectively, is in the rear end position or, as shown in FIG. 6, between the front and the rear end positions, the valve 37 is in switching status B. In this status, the valve connections thereof are not connected to each other. The valve 38 is in position A when the piston 112 is at the outermost right; otherwise, it is in switching status B.

When the flip-flop valve 31 is in position A, compressed air is not applied to the control connection 32.2 of the main valve 32; instead, the control connection 32.2 of the main valve 32 is connected to the atmosphere. This causes the main valve 32 to be in switching status A. The reason behind this is that compressed air is generally applied to the control connection 32.1 of the main valve, with the main valve being designed as a differential valve. In switching status A, the compressed air coming from the compressed air source 50 is pressed into the compressed air chamber 114 and into the right-hand piston chamber 11.2 of the cylinder 11. The piston 12 is pressed to the left and pulls the diaphragm 10 also to the left in the direction of the rear end position. The volume in the supply chamber 13 is increased; the left-hand diaphragm pump is in the suction phase. The compressed air in the compressed air chamber 114 causes the diaphragm 110 to be pressed to the left in the direction of the front end position. The volume in the supply chamber 113 is reduced; the right-hand diaphragm pump is in the supply phase. During this phase, the connection 3 of the flip-flop valve 31 is closed, with the result that no compressed air is supplied from there. The connections of the valves 35 and 37 are also closed, with the result that compressed air is not instantly supplied from there either. Since the connection 5 of the flip-flop valve 31 is connected to the connection 7 that is open to the atmosphere, control air that is possibly present at the control connection 31.2 is supplied to the atmosphere outside. The control connection 31.2 is relieved and, therefore, not subject to any pressure. The connection 4 of the flip-flop valve 31 is closed and the connection of the valve 35 as well. As a result, the compressed air applied to the control connection 31.1 cannot escape while the air pressure at the control connection 31.1 is maintained.

While the piston rod 112.1 moves to the left, the valve 37 is still closed for the present. Once the piston rod 112.1 has moved far enough to the left, the valve 37 is opened by the groove 112.2 on the piston rod 112.1 and is then in status A.

While the piston rod 12.1 moves to the left, the valve 35 is still closed for the time being. Only when the piston rod 12.1 has moved far enough to the left, will the valve 35 be opened by the groove 12.2 on the piston rod 12.1 and move to status A. As soon as the two valves 37 and 35 have moved to status A, the compressed air is supplied from the compressed air source 50 via the valve 37 and the valve 35 to the control input 31.1 of the flip-flop valve 31.

Thereby, the flip-flop valve 31 moves to position B for a certain time period. The control connection 32.2 of the main valve 32 still remains unpressurized because it is not supplied with compressed air via the flip-flop valve 31. For this reason, the main valve 32 remains in the previous position. The connections 3 and 4 of the flip-flop valve 31 remain closed. The connection 5 of the flip-flop valve 31, however, is now being closed. As a result, the control air at the control connection 31.2 can now no longer escape to the atmosphere.

After a certain time period, the flip-flop valve 31 moves from position B to position C. Compressed air is now being applied to the control connection 32.2 of the main valve 32. The main valve 32 changes from position A to position B. As a result, compressed air enters into the left-hand piston chamber 111.1 of the cylinder 111 and into the compressed air chamber 14. Thereby, the piston 112 is pressed to the right; the piston, in turn, pulls the diaphragm 110 to the right in the direction of the rear end position. The right-hand diaphragm pump is now in the suction phase. The pressure in the compressed air chamber 14 causes the diaphragm 10 to be pressed to the right in the direction of the front end position. The left-hand diaphragm pump is now in the supply phase.

The flip-flop valve 31 moves to switching status D. While the piston rod 112.1 moves to the right, the valve 37 is being closed while the valve 38 still remains closed for the time being. Once the piston rod 112.1 has moved far enough to the right, the annular groove 112.2 on the piston rod 112.1 moves the valve 38 from position B to position A.

While the piston rod 12.1 moves to the right, the valve 35 is closed; for the time being, the valve 36 still remains closed but is connected to the control input 32.2 of the main valve 32 on its output side via the flip-flop valve 31. Only when the piston rod 12.1 has moved far enough to the right, will the annular groove 12.2 on the piston rod 12.1 move the valve 36 from position B to position A. Thereby, compressed air is supplied from the compressed air source 50 via the valve 36 and the valve 38 to the control input 31.2 of the flip-flop valve 31. The flip-flop valve 31 again returns from status D to status C for a short time and then to status B and finally remains in status A. During this time period, this procedure is repeated in reverse order wherein, this time, the left-hand diaphragm pump is the supply pump and the right-hand diaphragm pump is the suction pump.

Embodiment with a Pressure Transmission Ratio of >1:1

The exemplary embodiment of the double diaphragm pump according to the invention shown in FIG. 7 has a pressure transmission ratio of >1:1. This means that the pressure acting on the pump chamber is in excess of the pressure acting on the pressure chamber.

In contrast to version 1:1 according to FIG. 6, the cylinder chamber 11.1 is not connected to the atmosphere; instead, compressed air is applied to it for a certain time period at certain times. This means that the pressure acting on the pump chamber 13 is in excess of the pressure acting on the pressure chamber 14. The cylinder chamber 111.2 is not connected to the atmosphere either; instead, compressed air is applied to it for a certain time period at certain times. This allows reaching higher supply pressures which are of advantage for certain media, e.g., media having a higher viscosity. Higher supply pressures can also be of advantage when longer distances have to be covered.

In order that compressed air can be applied to the cylinder chambers 11.1 and 111.2, it is reasonable to seal them off appropriately. Seals would therefore still have to be added to the embodiment of the cylinder chambers shown in FIGS. 3 and 4. O-rings that are placed between the cylinder wall and the housing 9 can be used as seals.

Further Embodiment with a Pressure Transmission Ratio of >1:1

As is the case with the embodiment shown in FIG. 7, the exemplary embodiment of the double diaphragm pump according to the invention shown in FIG. 8 is a version with a pressure transmission ratio of >1:1.

As is the case with the first and second embodiments, a flip-flop valve is used in the control 30 of the third embodiment as well; however, this flip-flop valve has only two switching statuses A an B. In the resting state, i.e., while no control signals are present at the control inputs 39.1 and 39.2 of the flip-flop valve 39, the latter is in switching status A.

At the beginning, the main valve 32 therefore is in status A and supplies the compressed air coming from the compressed air source 50 into the cylinder chamber 11.2, the pressure chamber 114 and the cylinder chamber 111.2. Thereby, the piston 12 is pressed to the left. Using the piston rod 12.1, the piston 12 pulls the diaphragm 10 to the left as well, with the result that low pressure develops in the pump chamber 13. The left-hand diaphragm pump is now in the suction phase. The piston 112 is also pressed to the left. Using the piston rod 112.1, the piston 112 pulls the diaphragm 110 to the left as well, with the result that high pressure develops in the pump chamber 13. This is supported by the pressure chamber 114 which is subject to compressed air. The right-hand diaphragm pump is now in the pump phase.

As soon as the piston 12 has reached the left end position, the groove 12.2 in the piston rod 12.1 moves the valve 35 from status B to status A. Once the piston 112 has also reached the left end position, the groove 112.2 in the piston rod 112.1 also moves the valve 37 from status B to status A. Thereby, compressed air flows to the control input 39.1 of the flip-flop valve 39 and causes the latter to move from status A to status B. The flip-flop valve 39 now supplies the compressed air to the control input 32.2 of the main valve 32, with the result that the latter also moves from status A to status B. The compressed air is now supplied from the compressed air source 50 via the main valve 32 into the cylinder chamber 11.1, the pressure chamber 14 and the cylinder chamber 111.1. Thereby, the piston 12 is pressed to the right. Using the piston rod 12.1, the piston 12 pulls the diaphragm 10 to the right as well, with the result that high pressure develops in the pump chamber 13. The left-hand diaphragm pump is now in the pump phase. This is supported by the pressure chamber 14 which is subject to compressed air. The piston 112 is also pressed to the right. Using the piston rod 112.1, the piston 112 pulls the diaphragm 110 to the right as well, with the result that low pressure develops in the pump chamber 13. The right-hand diaphragm pump is now in the suction phase. In addition, the two control inputs 39.1 and 39.2 of the flip-flop valve 39 are each connected to the atmosphere via a restrictor 40 and 41, respectively, with the result that the control inputs 39.1 and 39.2 can be deaerated when there is no control command coming from the valves 35 and 38.

Combined Control

As a matter of course, the aforementioned embodiments of the control can also be combined with each other. For example, the condition for triggering a specific command can be related to time while the condition for triggering another command is related to the position of a specific component. What is more, the condition for triggering a further command can be related to the pressure at a specific location. The condition triggering a command may be any physical property, such as time, location, pressure, etc. It is also possible to combine many conditions with each other. For example, a command may only be triggered if two conditions are fulfilled (AND relation). A command may also be triggered if one of two conditions is fulfilled (OR relation). It is also possible that a command is issued constantly until a further command for resetting the command is applied.

The end position switch 35 at the driving means 15 and the end position switch 37 at the driving means 115 can be used to ensure that both driving means 15 and 115 have covered the complete stroke.

An isochronous control of the first and second diaphragm pumps is of advantage but not necessarily required. Here, isochronous is understood to mean that the signals are in constant phase relation to each other. For example, the control signals generated by the valves 35 and 37 can be isochronous in relation to each other. In addition, the control signals generated by the valves 36 and 38 can be isochronous in relation to each other. Preferably, the phase shift thereof is between 170 degrees and 190 degrees. The pressure curves p1 and p2 can also be isochronous in relation to each other. Both pressure curves p1 and p2 are identical and have the same cycle time but they are offset against each other in time to a greater or lesser extent. Preferably, the phase shift thereof is also between 170 degrees and 190 degrees.

The above description of the exemplary embodiments according to the present invention only serves illustrative purposes. Various alterations and modifications are possible within the scope of the invention. For example, the first and second diaphragm pumps according to FIGS. 1 to 5 can be operated both with the control according to FIG. 6 and the control according to FIG. 7 or 8. The components shown can also be combined with each other in a different manner than that shown in the figures.

In the stead of the compressed-air-operated driving means 15, 115 shown in the figures, it is also possible to use driving means in which the piston 12 or 112, respectively, can be moved in at least one direction by means of a springy element. A combination of compressed air drive and spring drive is also conceivable.

In the stead of the pistons 12, 112 shown in the figures, the cylinders 11 and 111 can also each comprise a diaphragm. The diaphragm may also have the form of a roll diaphragm. These diaphragms that are arranged in the cylinders can be moved with compressed air and/or with a springy element. The springy element may, for example, be a compression spring.

A roll diaphragm is a flexible seal which allows a relatively long piston stroke. Often, it has the form of a truncated cone or a cylinder and is rotated in itself. The roll diaphragm can be clamped circumferentially. During the stroke, it alternately rolls on the piston and on the cylinder wall. The rolling motion is smooth and frictionless. There is no sliding friction, no breaking friction and no pressure loss.

If the pistons 12 and 112 or the diaphragms arranged in the cylinders, respectively, are to be moved via a compression spring, this is preferably done in the suction phase of the diaphragm pump in question. Advantageously, the compression springs are then disposed in the cylinder chambers 11.2 and 111.2.

In case of the double diaphragm pump 1, it can be provided that the driving means 15 and 115 each comprise at least one sensor. The sensor serves to register the position of the driving piston 12 or the piston rod 12.1, or the driving piston 112 or the piston rod 112.1, respectively.

For example, an end position switch can be used as a sensor. The end position switch can be used to register the end position (dead center) of the driving means 15. The driving means 15 can also comprise an end position switch to register the left end position and a further end position switch to register the right end position (not shown in the figures). The same can apply to the driving means 115. FIGS. 5 to 8 show the end position switches designed as valves 35 to 38. In the stead thereof, they can also be electric or mechanical switches. In this case, the control has to be adjusted to these switches.

If the driving cylinders 11 and 111 are selected such that they are twice as large as the diaphragms 10 and 110, respectively, or even greater in size, it is also possible to achieve a pressure transmission ratio of, for example, 3:1. This means that an air pressure of 6 bar then corresponds to a fluid pressure of 18 bar.

During ongoing operation, the diaphragms 10 and 110 are moved to and fro. Therein, it may happen that the diaphragms fold down; this, however, is usually undesired because this may damage the diaphragm. To reduce the risk that the diaphragms 10 and 110 fold down and are, thereby, gradually damaged, the following structure can be provided. The pressure chamber 14 at the diaphragm 10 and the pressure chamber 114 at the diaphragm 110 are not connected to the main valve 32 but to a vacuum generator. The latter generates a vacuum in the two pressure chambers 14 and 114 that is so high that the diaphragms 10 and 110 do not fold down but essentially maintain their shape.

The diaphragms 10 and 110, respectively, can be mechanically prestressed prior to the supply phase. Thereby, the diaphragm generates a certain pressure in the supply chamber right at the beginning of the supply phase until, amongst other things, the air pressure has built up in the pressure chamber. This allows compensating the inertia of the system and making a fine adjustment. The diaphragms should not be prestressed too strongly because this can, otherwise, sometimes result in a serrated pressure curve.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

LIST OF REFERENCE NUMBERS

1 Double diaphragm pump
2 Pump inlet
3 Pump outlet
4 Compressed air connection
5 Check valve
6 Check valve
7 Compressed air connection
8 Shut-off valve
9 Housing
10 Diaphragm
11 Cylinder
11.1 Left-hand piston chamber
11.2 Right-hand piston chamber
12 Piston
12.1 Piston rod
12.2 Annular groove in the piston rod
13 Pump or supply chamber
13.3 Pump chamber outlet
14 Pressure chamber
15 Driving means
17.1 Wall
17.2 Wall
18 Wall
19 Wall
20 Pressure adjuster
21 Pressure adjuster
22 Pressure gauge
23 Pressure gauge
31 Control
31 Flip-flop valve
31.1 Control connection
31.2 Control connection
32 Main valve
32.1 Control connection
32.2 Control connection
33 Pressure relief valve
35 Valve
36 Valve
37 Valve
38 Valve

39 Flip-flop valve
39.1 Control connection
39.2 Control connection
40 Restrictor
41 Restrictor
50 Compressed air source
105 Check valve
106 Check valve
110 Diaphragm
111 Cylinder
111.1 Left-hand piston chamber
111.2 Right-hand piston chamber
112 Piston
112.1 Piston rod
112.2 Annular groove in the piston rod
113 Pump or supply chamber
113.3 Pump chamber outlet
114 Pressure chamber
115 Driving means
p1 Pressure at the output of the double diaphragm pump 1
p13 Pressure in the pump chamber 13
p113 Pressure in the pump chamber 113
pv Preliminary pressure

The invention claimed is:

1. A double diaphragm pump, comprising:

a housing containing a first diaphragm and a second diaphragm, wherein the first diaphragm forms a wall of a first pump chamber, and the second diaphragm forms a wall of a second pump chamber, a first actuator rigidly coupled to the first diaphragm via a first rod, the first actuator being configured to move the first diaphragm via the first rod, a second actuator rigidly coupled to the second diaphragm via a second rod, the second actuator being configured to move the second diaphragm via the second rod, wherein the first diaphragm is not rigidly coupled to the second diaphragm so as to allow movement of the first and second diaphragms without rigid mechanical interdependence on each other, and wherein one or more valves are provided to control movement of the first and second actuators, said one or more valves being configured such that it the one or more valves controls the first and second actuators subject to one or a plurality of conditions.

2. The double diaphragm pump according to claim 1, wherein the condition relates to time, pressure, distance and/or position.

3. The double diaphragm pump according to claim 1, wherein the one or more valves are designed and operable such that, before the diaphragm in one pump chamber has reached its dead center, the one or more valves already ensures that pressure is built up in the other pump chamber.

4. The double diaphragm pump according to claim 1, wherein the one or more valves are designed and operable such that, if a pressure in one pump chamber drops below a specific threshold value, the one or more valves ensures that pressure is built up in this pump chamber.

5. The double diaphragm pump according to claim 1, wherein the one or more valves is designed and operable such that the one or more valves controls the first and second actuators to respectively move the first and second diaphragms at different cycle times, such that the cycle times are offset relative to each other.

6. The double diaphragm pump according to claim 1, wherein the one or more valves are designed and operable such that the one or more valves controls the first and second actuators isochronously in relation to each other.

7. The double diaphragm pump according to claim 1, wherein a first pressure chamber which is separated from the first pump chamber by the first diaphragm is provided, wherein a second pressure chamber which is separated from the second pump chamber by the second diaphragm is provided.

8. The double diaphragm pump according to claim 1, wherein at least one of the first and second actuators is an actuator that can be operated with compressed air.

9. The double diaphragm pump according to claim 1, wherein the first and second actuators each comprise a piston that is movable in a cylinder or a diaphragm that is movable with compressed air.

10. The double diaphragm pump according to claim 1, wherein the first and second actuators each comprise a piston that is movable in a cylinder or a diaphragm that is movable in at least one direction with a springy element.

11. The double diaphragm pump according to claim 1, wherein the first and second actuators each comprise at least one sensor to register an end position.

12. The double diaphragm pump according to claim 11, wherein the one or more valves are designed and operable such that the one or more valves controls the first and second actuators subject to a signal coming from the respective sensor.

13. The double diaphragm pump according to claim 11, wherein, when the at least one sensor of the first actuator registers the end position of the first actuator, the at least one sensor of the first actuator signals to the one or more valves to initiate a reversal in direction of the first actuator; and wherein, when the at least one sensor of the second actuator registers the end position of the second actuator, the at least one sensor of the second actuator signals to the one or more valves to initiate a reversal in direction of the second actuator.

14. The double diaphragm pump according to claim 1, wherein the first and second pump chambers each comprise a pump chamber outlet and wherein the pump chamber outlets end in a common pump outlet.

15. The double diaphragm pump according to claim 1, wherein the one or more valves comprises a differential valve, wherein, while it is in one position (A), the differential valve connects a compressed air source to the first actuator such that it moves the first diaphragm such that a reduction in pressure develops in the first pump chamber, wherein, while it is in the other position (B), the differential valve connects the compressed air source to the second actuator such that it moves the second diaphragm such that a reduction in pressure develops in the second pump chamber.

16. The double diaphragm pump according to claim 15, wherein the differential valve, while it is in one position (A), connects the compressed air source to the second actuator such that it moves the second diaphragm such that an increase in pressure develops in the second pump chamber, wherein, while it is in the other position (B), the differential valve connects the compressed air source to the first actuator such that it moves the first diaphragm such that an increase in pressure develops in the first pump chamber.

17. The double diaphragm pump according to claim 15, wherein the one or more valves comprises a flip-flop valve that can be controlled with end position switches and that controls the differential valve.

* * * * *